United States Patent [19]

Janik, Jr.

[11] 4,170,210

[45] Oct. 9, 1979

[54] AIR STARTER

[75] Inventor: Leon P. Janik, Jr., Hazardville, Conn.

[73] Assignee: Stanadyne, Inc., Windsor, Conn.

[21] Appl. No.: 809,103

[22] Filed: Jun. 22, 1977

[51] Int. Cl.[2] ..... F02N 17/00

[52] U.S. Cl. ..... 123/179 F

[58] Field of Search ..... 123/179 F; 74/7 R; 192/0.084

[56] References Cited

U.S. PATENT DOCUMENTS

| | | | |
|---|---|---|---|
| 3,051,136 | 8/1962 | Muehlhausen | 123/179 F |
| 3,182,650 | 5/1965 | Hecht | 123/179 F |
| 3,722,210 | 3/1973 | Kuhn | 123/179 F |
| 3,794,009 | 2/1974 | Wenrich et al. | 123/179 F |
| 3,816,040 | 6/1974 | Janik | 123/179 F |

*Primary Examiner*—Charles J. Myhre

*Assistant Examiner*—David D. Reynolds

*Attorney, Agent, or Firm*—Prutzman, Kalb, Chilton & Alix

[57] ABSTRACT

An air starter having a rotary air motor and a drive pinion mounted on radially offset drive shafts in axially disposed housings which are connected by an intermediate common flange. The flange provides a pair of grooves which are concentric with each other and with one of the shafts. Air passages in the two housings are disposed to communicate with the grooves regardless of the relative angular orientation of the two housings. Also disclosed is pneumatically controlled main air valve which incorporates a lubricator for injecting a charge of lubricant into the incoming air stream as the valve opens and a shock absorber to regulate the closing movement of the main air valve against the bias of incoming air pressure.

5 Claims, 7 Drawing Figures

COMPRESSED AIR SOURCE 28
66
32
30
64
60
34
36
22
37
24
38
57
62
56
40
58
42
67
10
54
12
46
50
44

AIR STARTER

This invention relates to air starters and particularly to air starters wherein the air motor shaft is offset from the drive pinion shaft and is an improvement upon the air starter disclosed and claimed in my prior U.S. Pat. No. 3,816,040 issued June 11, 1974.

Air starters of the type involved in this invention are generally used on a variety of compression ignition engines of different designs and the mounting of such starters on engines of different designs require that the starter motor housing be mounted at different relative angular positions with respect to the gear housing containing the drive pinion and this requirement has heretofore complicated the piping connections for connecting the air motor of the starter with the air operated pinion drive mechanism which causes the engagement of the drive pinion with the flywheel prior to the energization of the air motor.

It is an object of the present invention to provide improved means for making these air connections automatically regardless of the relative angular disposition of the starter motor housing with respect to the gear housing.

Another object of this invention is to provide an improved lubricator-sequencing valve mechanism in which the high impact shock loads normally imposed on the mechanism are minimized.

Other objectives will be in part obvious and in part pointed out more in detail hereinafter.

This invention accordingly consists of the features of construction, combination of elements, and arrangement of parts which are exemplified in the construction hereafter set forth, and the scope of the application of which will be indicated in the appended claims.

Figure 1:
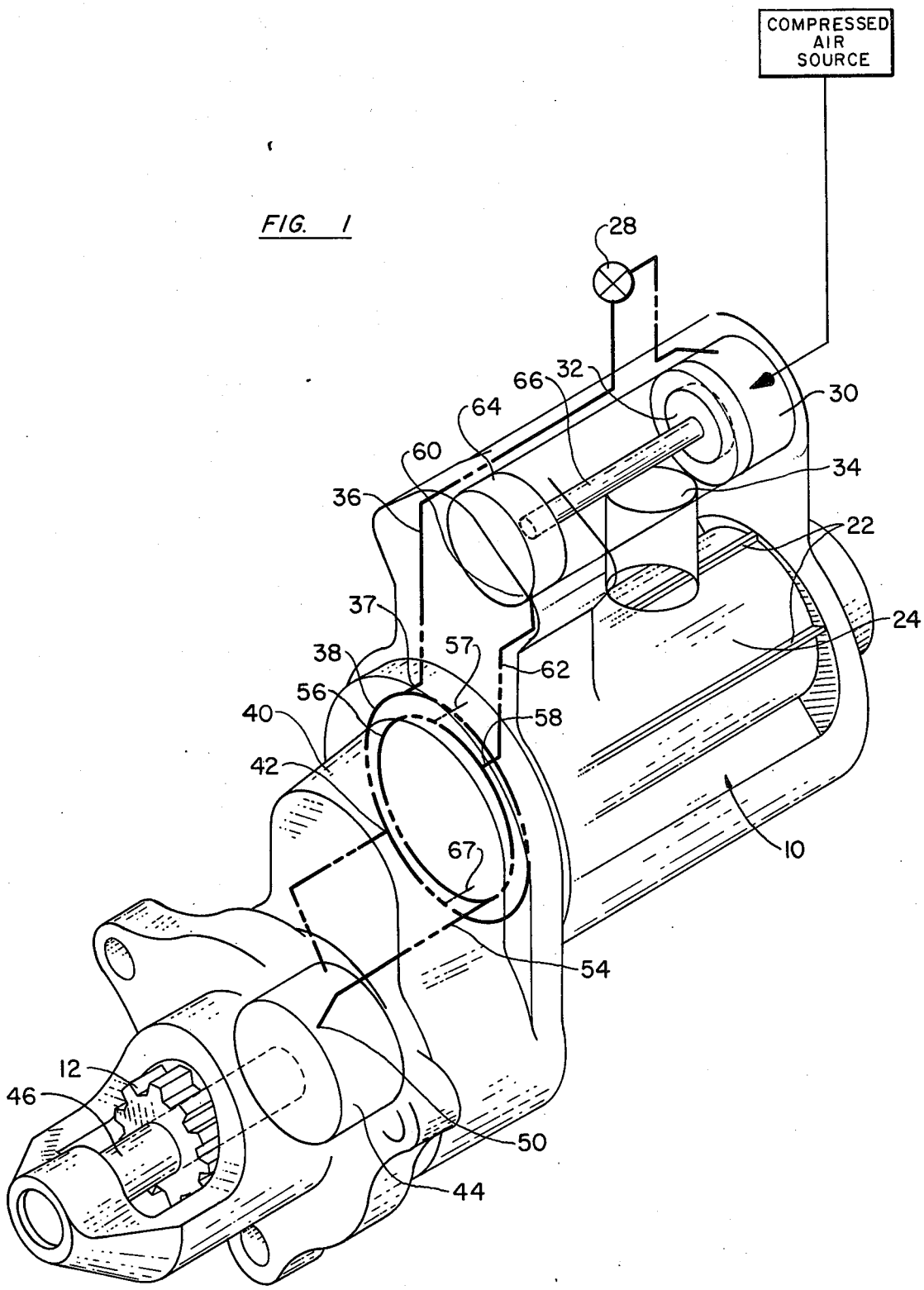
FIG. 1 is a simplified schematic view of an air starter incorporating the present invention.

Referring to the drawings in greater detail, the illustrative air starter embodying this invention is shown as comprising an air motor 10 connected through a gear train to a pinion gear 12 which meshes with the engine flywheel for starting the engine.

Starter motor 10 is of the vane type and a plurality of vanes 22 are slidably mounted in radial slots of a hub 24 for rotation within a stationary eccentric liner in the usual manner for supplying the torque for driving the motor shaft 26.

Figure 3:
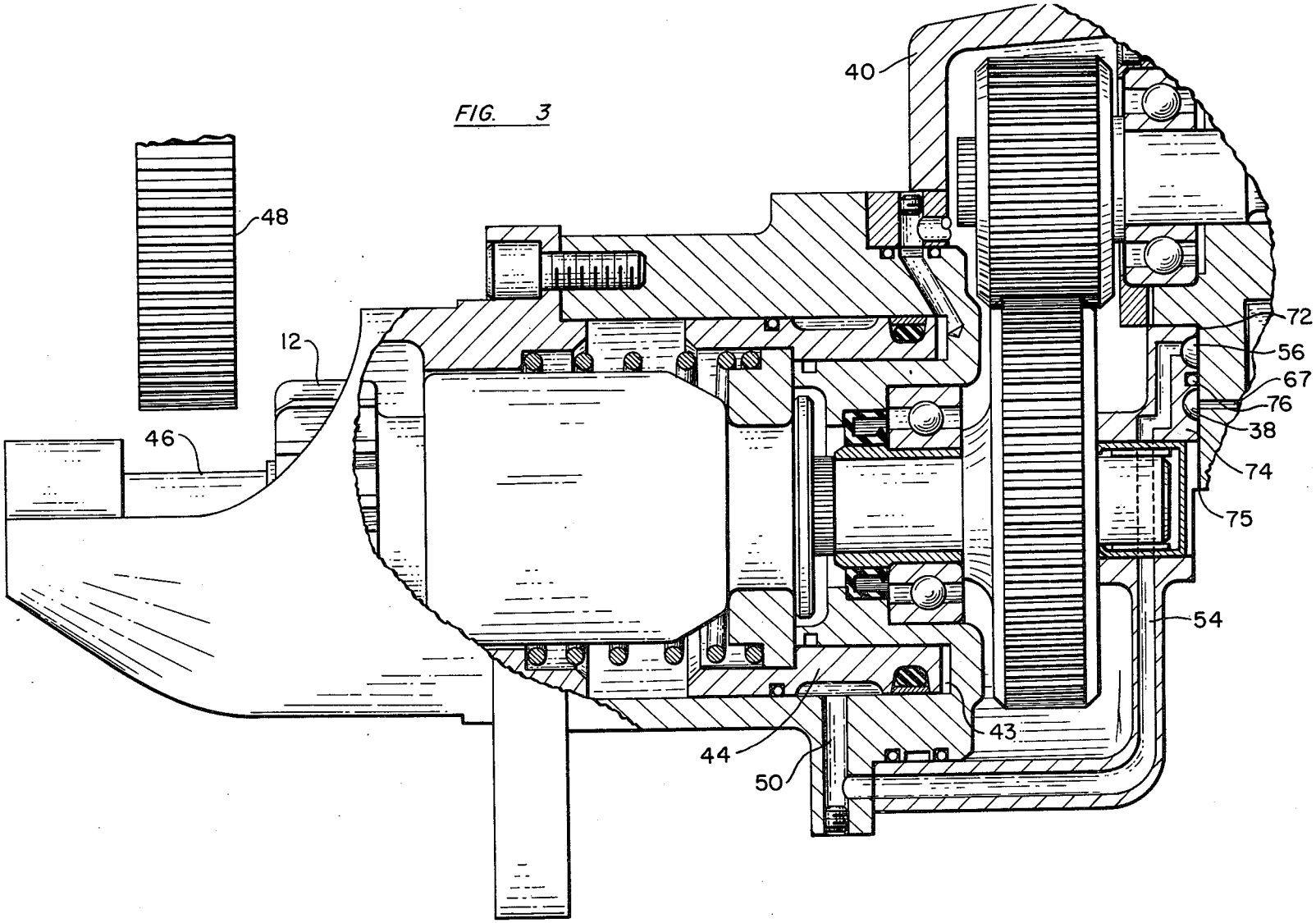
FIG. 3 is a fragmentary side elevation view, partly broken away, showing the drive pinion and gear train portion of the air starter.

As shown, air or gas from a compressed air source is continously applied to inlet port 30. Main air control valve 32, provided with an O-ring seal about its periphery, initially blocks communication between inlet port 30 and the valve outlet passage 34. A control valve 28 communicates with inlet port 30 and controls the delivery of compressed air to a control circuit through internal passage 36, as schematically illustrated in FIG. 1, to an annular passage 38 which communicates with an air passage in the gear housing 40 through a port 42. Port 42 communicates with a piston chamber 43 (FIG. 3) for piston 44 which shifts the pinion 12 axially along drive shaft 46 to a position at which the pinion 12 meshes with an engine flywheel 48.

When the pinion 12 is engaged with the flywheel 48, the actuator piston 44 uncovers a port 50 to provide communication between air chamber 43 at the end of actuator piston 44 so that the control air may then pass through internal passage 54 to a second annular passage 56 which communicates through a port 58 of a passage 62 in the starter motor housing with air chamber 60 at one end of a unitary lubricator-sequencing valve mechanism to move the lubricator-sequencing valve to the right as viewed in FIG. 1. In this regard, it will be noted that the cross sectional area of the lubricator piston 64 is greater than the cross sectional area of main air control valve 32, which are fixedly connected to each other by a stem 66, so that when equal pressure is applied to main air control valve 32 and lubricator piston 64 in opposite directions, the lubricator-sequencing valve will be moved to the right so that compressed air from inlet port 30 may enter the air motor 10 and rotate the engine through flywheel 48.

It is apparent that with the above described arrangement, pinion 12 must be engaged with flywheel 48 before supply air is applied to the starter motor to rotate the engine for starting.

If desired, and as shown schematically in FIG. 1, a small bleed passage 67 providing communication between annulus 38 and the interior of the starter motor may be provided to bleed any air which may be trapped in piston chamber 43. In addition, control valve 28 is preferably a three-way valve so that it rapidly dumps the air downstream thereof, after control valve 28 is closed. A similar bleed passage 57 may be provided to vent the chamber 60 so that the lubricator-sequencing valve may return to its rest position after the starter has been actuated.

As indicated above, the profile of the space available for mounting air starters differs for different engine and, particularly where the starter motor is of the offset type, the orientation of the motor housing with respect to the gear housing must be varied for different installations.

Figure 2:
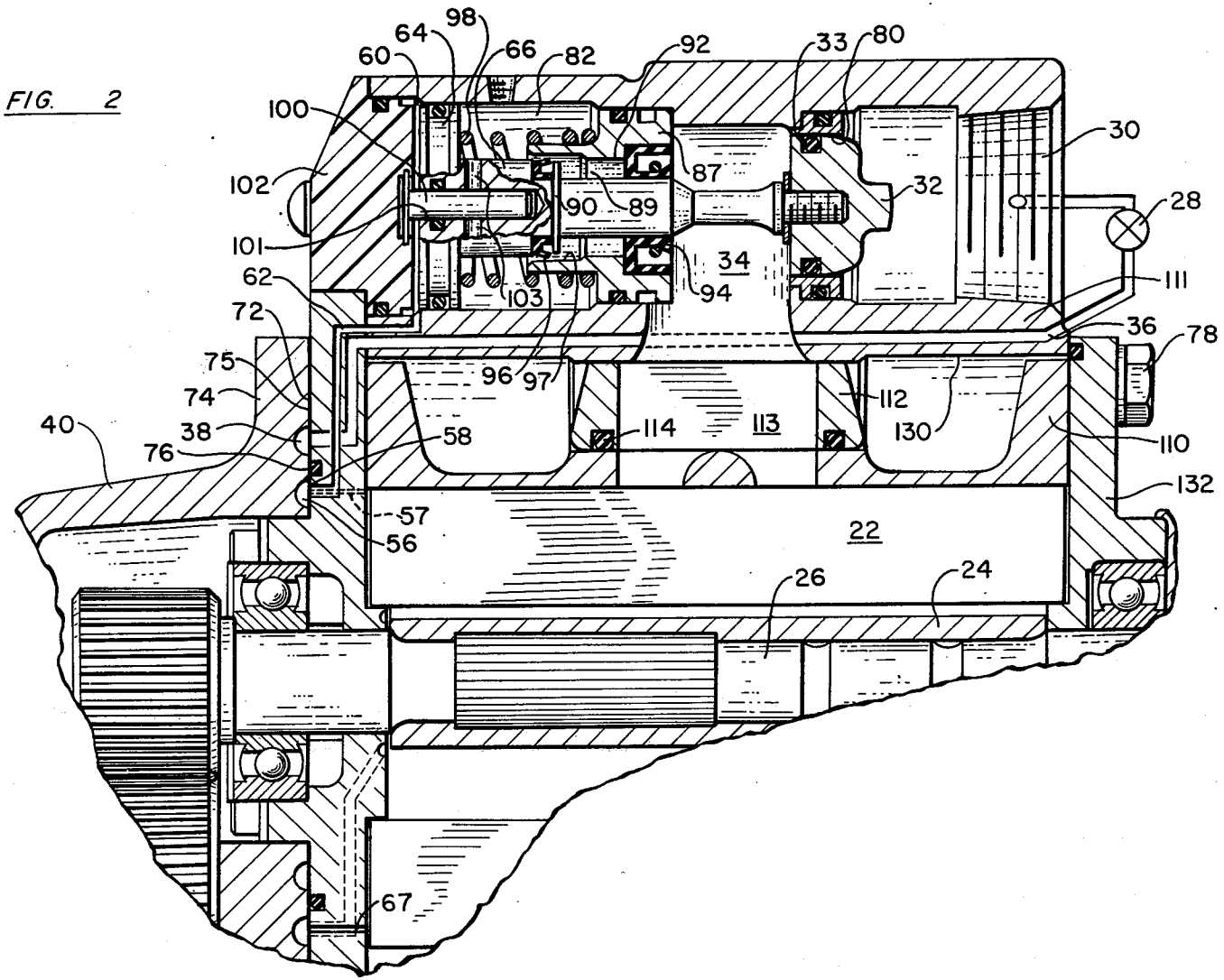
FIG. 2 is a fragmentary cross sectional view showing the lubricator-sequencing valve and the air motor thereof.
Figure 4:
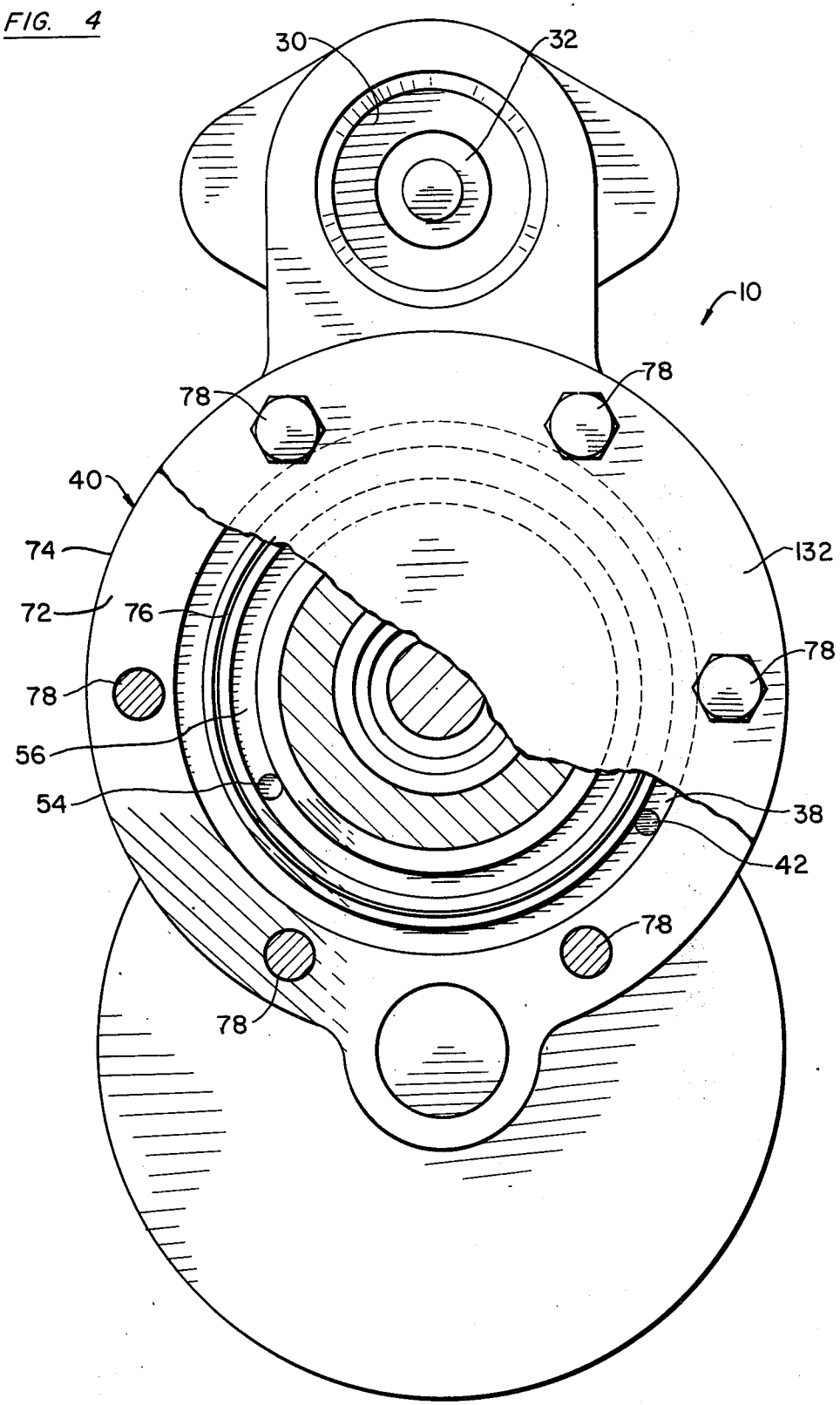
FIG. 4 is an end view, partly broken away, showing some of the internal air passages of the air starter.

An important feature of this invention is that means are provided wherein air connections between the starter motor housing and the gear housing are automatically made, regardless of the orientation of the two housings with respect to each other. This is accomplished by providing a pair of spaced annular passages 38 and 56 between the gear housing and the starter motor housing as schematically illustrated in FIG. 1 and as shown in FIGS. 2 and 4. These annular passages are formed as grooves on the end wall 72 of mounting flange 74 of the gear housing and are concentric with motor shaft 26. Ports 37 and 58, provided on the mating end wall of the motor housing, are disposed at the same radial distances relative to motor shaft 26 as the concentric grooves 38 and 56 so that these ports respectively communicate with the grooves regardless of the relative rotational relationship of the motor housing and the gear housing.

A gasket 75 and an O-ring seal 76 isolate the two annular passages from each other and prevent leakage from between the housings when bolts 78, securing the starter housing and the gear housing together, are tightened.

As herein before described, after pinion 12 is engaged with flywheel 48, compressed air is admitted to the lubricator-sequencing valve chamber 60 to move the lubricator-sequencing valve to the right to open the valve and admit air into the air motor.

As shown in FIG. 2, the lubricator-sequencing valve assembly includes an annular lubricant reservoir 82 surrounding the valve stem 66 and a second lubricant chamber 89 defined by a reduced diameter portion of the valve stem 66 and the surrounding stepped axially projecting annular wall of seal support ring 87.

As the lubricator-sequencing valve moves to the right at the initiation of a starting cycle, the flange 90 enters the reduced diameter portion 92 of the chamber 89 to trap the lubricant in the reduced diameter portion 92 of the chamber 89 and inject it past the lip seal 94 into the incoming compressed air entering the air motor. Thus, the lip seal 94 serves as a oneway valve in addition to its normal function as a pressure seal guarding against the entry of compressed air from cavity 34 into lubrication chamber 89.

At the termination of the starting operation, valve 28 is closed and the lubricator-sequencing valve is returned to its rest position as shown in FIG. 2 as the air bleeds from valve chamber 60 and lubrication chamber 89 is recharged from the lubricant reservoir 82 through the clearance between the flange 90 and its seal 96 and the enlarged diameter portion 97 of the axial flange of seal support ring 87.

Since compressed air pressure is always present at the inlet port 30 of the air motor, it is apparent that once the supply pressure in the control circuit has been dissipated due to the closing of the control valve 28, air pressure in chamber 60 will become less than air pressure at inlet port 30 and the lubricator-sequencing valve will be returned to its position under influence of high air pressure at inlet port 30 and the return spring 98. This would normally produce a very high velocity return of the lubricator-sequencing valve with the attendant shock loading when its movement is terminated by the end wall of chamber 60.

Another feature of this invention is the provision of means to reduce this unwanted shock loading. As shown, a pin 100 is mounted in a recess of end wall 102 and is fixed therein. Pin 100 is positioned to fit within a blind bore 101 of piston 64 and piston stem 66. A pair of of radial ports 103 provide communication between lubricant chamber 82 and blind bore 101 so that when lubricator-sequencing valve is moved to its right hand position during the operation of the motor, blind bore 101 is filled with lubricant. Thus, when the lubricator-sequencing valve returns at the termination of an air starting operation to its rest position the captive lubricant in blind bore 101 hydraulically dampens the return of the valve by an amount determined by the leakage of lubricant past pin 100. Such controlled leakage has been found to dissipate the strain on the lubricator valve so that all parts of the lubricator-sequencing valve may have a long life.

As shown in FIG. 2, the eccentric liner 110 of the air motor is positioned in a generally cylindrical chamber 111 of the motor housing and is provided with an inlet adapter 112 to connect the interior of the motor with air passage 34. The adapter provides a central air passage 113 and is sealed to the flat top surface of the eccentric liner 110 by an O-ring 114. A pair of locator pins 118, positioned in recesses 120, are provided to fix the position of adapter 112 relative to the O-ring.

Figure 5:
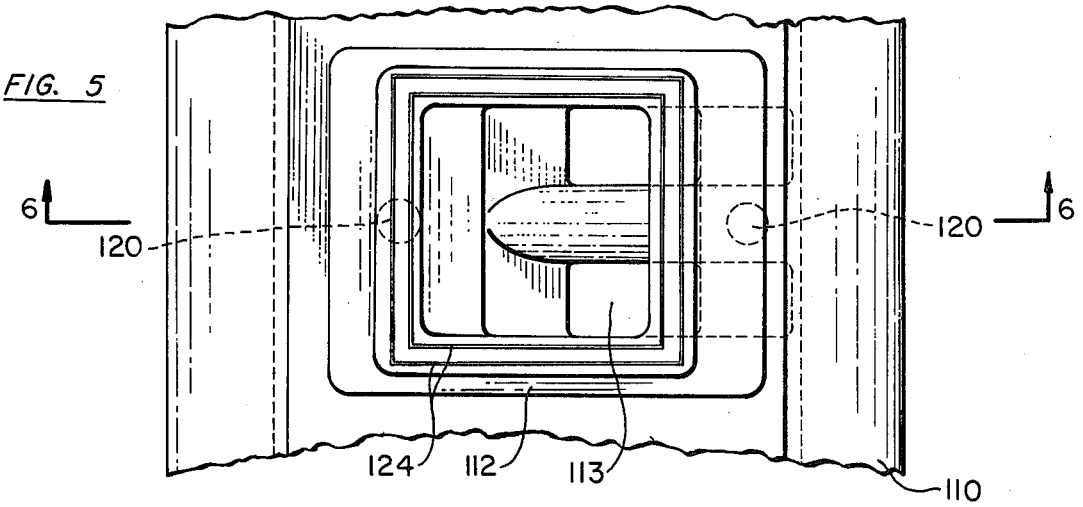
FIG. 5 is a top view of the eccentric liner of the vane type air motor used in the invention, and its air inlet adapter.
Figure 6:
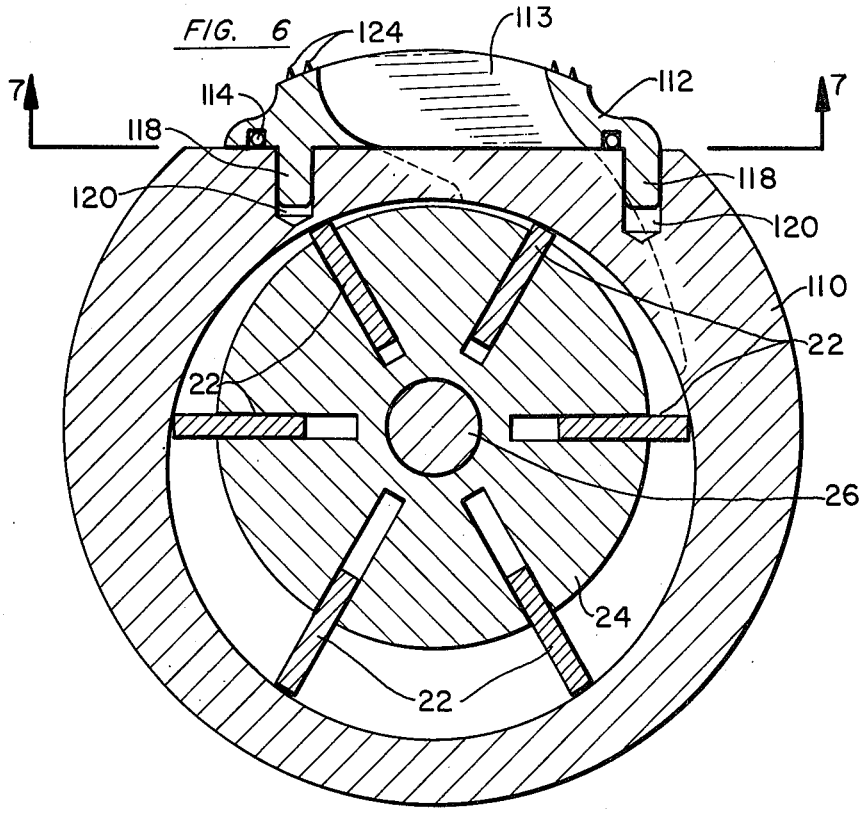
FIG. 6 is a cross sectional view taken along line 6—6 of FIG. 5.
Figure 7:
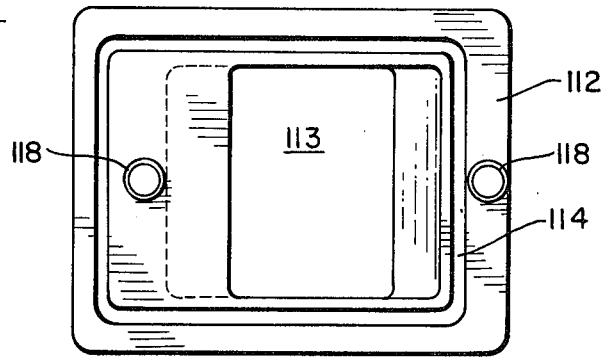
FIG. 7 is a view taken along line 7—7 of FIG. 6.

As will be apparent from FIG. 5, the top profile of adapter 112 lies in the same circular profile as the outer surface of the eccentric liner 110. Adapter 112 is molded from a suitable plastics material and, as shown in FIGS. 5 and 6, is provided on its top surface with a pair of unbroken spaced ridges 124, which are shown as being triangular in cross section, surrounding the air passage through the adapter.

The eccentric liner 110 with the adapter 112 assembled thereon, are assembled axially into the generally cylindrical bore 130 of the motor housing before the end plate 132 is assembled. The ridges 124 readily deform to conform to the mating wall of bore 130, thereby to accomodate manufacturing variations, while at the same time applying a biasing force on O-ring 114, through providing a tight seal.

It will be also noted that these ridges 124 are located to define an area which is less than the area defined by O-ring 114. Thus air pressure passing through adapter 112 exerts a force on the lower surface of the adapter which is greater than the force exerted downwardly to pneumatically bias the ridges 124 against the inner periphery of the housing to prevent leakage of compressed air from the inlet passage 113.

As will be apparent to persons skilled in the art, various modifications, adaptations and variations of the foregoing specific disclosure can be made without departing from the teachings of the present invention.

I claim:

1. An air starter including an air motor having a first housing with an air inlet suited for receiving air from a source of high pressure to power the air motor and an axially movable drive pinion having a second housing and being selectively engageable with an engine flywheel to rotate the same, said air motor and said drive pinion being respectively mounted on axially displaced radially offset gear connected shafts, an air operated piston for advancing said drive pinion to engage said flywheel, and air passage means providing communication between said air inlet and said piston, said air passage means including a pair of spaced grooves on the end wall of a mounting flange of one of said housings and a pair of ports on the mating end wall of a mounting flange of the other of said housings, aid grooves being concentric with the shaft mounted by the other of said housings and said ports being disposed at the same radial distances respectively as said grooves from said shaft of the other of said housing and the same radius from said shaft of said one housing to provide communication with said grooves regardless of the relative angular disposition of said housings with respect to each other.

2. The air starter of claim 1 wherein said grooves are on the drive pinion housing.

3. The air starter of claim 1 including an air operated main air control piston at said inlet and an air operated piston in said air motor housing for actuating said main air control valve, said actuating piston being connected in series with said piston for advancing said pinion through one of said concentric grooves.

4. The air starter of claim 1 including an air control valve in series with said piston for advancing said pinion through the other of said grooves.

5. The air starter of claim 1 including bleed passages from each of said grooves communicating with the interior of said air motor.

* * * * *